United States Patent [19]

MacDonald

[11] 4,292,776

[45] Oct. 6, 1981

[54] UNITARY COMBINED BACKER AND SIDING BOARD

[76] Inventor: Milton MacDonald, 5 Holly St., Woodsville, N.H. 03785

[21] Appl. No.: 66,030

[22] Filed: Aug. 13, 1979

[51] Int. Cl.[3] ..... E04B 1/66

[52] U.S. Cl. ..... 52/394; 52/309.13; 52/403; 52/539; 52/556

[58] Field of Search ..... 52/394, 403, 309.13, 52/309.15, 233, 539, 556

[56] References Cited

U.S. PATENT DOCUMENTS

| | | | |
|---|---|---|---|
| 122,562 | 1/1872 | Buscher | 52/539 |
| 274,354 | 3/1883 | McCarthy et al. | 52/592 |
| 389,090 | 9/1888 | Liefer | 52/539 X |
| 1,859,667 | 5/1932 | Gruner | 52/578 |
| 2,231,008 | 2/1941 | Ochs | 52/556 X |
| 2,264,546 | 12/1941 | Ochs | 52/539 X |
| 2,321,120 | 6/1943 | Baker | 52/233 |
| 3,217,453 | 11/1965 | Medow | 52/539 X |
| 3,262,239 | 7/1966 | Mills | 52/539 X |
| 3,284,967 | 11/1966 | Elliott et al. | 52/539 X |
| 3,969,859 | 7/1976 | Hisey | 52/233 |

FOREIGN PATENT DOCUMENTS

| | | | |
|---|---|---|---|
| 1962552 | 7/1970 | Fed. Rep. of Germany | 52/403 |
| 1373787 | 8/1964 | France | 52/233 |
| 124957 | 4/1928 | Switzerland | 52/539 |
| 1292 | of 1875 | United Kingdom | 52/539 |

*Primary Examiner*—Alfred C. Perham
*Attorney, Agent, or Firm*—Pearson & Pearson

[57] ABSTRACT

A unitary combined backer and siding board is sufficiently thick and strong to eliminate the need for backer boards or plyscore as a substrate on the studs of the walls of a building. The board is standard, commercially available stock with parallel front and rear faces and of uniform thickness of about one and one quarter inches. The upper edge has a front, upstanding tongue of curved cross section which fits in a tongue groove of curved cross section in the lower edge. The upper edge is free of grooving and has a downward sloping surface between the upstanding tongue and the rear face to shed rainwater. A compressible sealing gasket is located between tongue and tongue groove.

7 Claims, 7 Drawing Figures

UNITARY COMBINED BACKER AND SIDING BOARD

BACKGROUND OF THE INVENTION

Novelty siding has long been available to the public in the form of elongated boards having an upper edge with an integral upstanding tongue and a lower edge with a tongue recess, rabbett or groove, the front face of each board usually having a groove to simulate clapboarding.

Such siding, panelling or sheathing is shown in many forms in, for example, a publication entitled "Standard Patterns", Western Wood Products Co. of Western Wood Products Association, Yeon Building, Portland, Oregon 97204.

Prior patents exemplary of such siding, decking, flooring, roofing or panelling are the following:

U.S. Pat. No. 2,400,357 May 14, 1946 to Krajci

U.S. Pat. No. 3,262,239 July 26, 1966 to Mills

U.S. Pat. No. 4,065,899 Jan. 3, 1978 to Kirkhuff in all of which the siding unit has an upper tongue and lower tongue groove but requires attachment to a substrate of boards or plyscore.

In the following U.S. Patents, however, all of which also disclose an upper tongue and a lower tongue recess, no backer board is used and the units are attached directly to the studs:

U.S. Pat. No. 2,231,007 Feb. 11, 1941 to Vane

U.S. Pat. No. 2,390,087 Dec. 4, 1945 to Fink

U.S. Pat. No. 2,693,621 Nov. 9, 1954 to Errion

U.S. Pat. No. 2,831,218 Apr. 22, 1958 to Stark

U.S. Pat. No. 3,626,439 Dec. 7, 1971 to Knessel

U.S. Pat. No. 4,034,439 July 12, 1977 to Sanders

Most of the above mentioned patents disclose an outer, lower, integral depending rib on the lower edge of the board for covering the joint with the next lower most board.

The above mentioned Mills U.S. Pat. No. 3,262,239, Fink U.S. Pat. No. 2,390,087 and Stark U.S. Pat. No. 2,831,218 all disclose laminated board units, and the Errion U.S. Pat. No. 2,693,621 discloses one piece units, which are of sufficient thickness, strength and insulative properties to be directly applied to frame studding thereby eliminating the cost and expense of an intervening substrate of shiplapped boards, plyscore or composition board.

SUMMARY OF THE INVENTION

The combined backer board and siding of this invention is characterized by being sufficiently thick at the top and bottom to serve as a rigid connection between upright studs without other support. The upper edge is preferably at least one and one quarter inches in thickness as is the lower edge, the lower edge being at least about one and one half inches in thickness when the outer or front face is tapered. Unlike the above prior patents, in this invention the upper edge contains a front, upstanding tongue and a rear, downward sloping surface to shed rainwater, there being no pockets, or grooves, in the upper edge to permit water to accumulate. The lower edge includes a rear depending tongue and a front depending tongue separated by a tongue groove which receives the tongue of the next lower board. Standard boards of uniform thickness are used and preferably a compressible gasket between upstanding tongue and tongue groove is provided to seal the joint between boards.

To avoid leakage of air or water at the joints, when the upstanding tongue is integral the tongue groove in the lower edge is made of slightly greater dimensions then the corresponding dimensions of the tongue to provide a predetermined clearance space for caulking or sealing compound. No caulking is necessary when the seal is a separate gasket of compressible material.

To enable nailing of each unit directly onto the studs of a building a nailing surface, or plane, at an angle of about 45° to the vertical may be provided on the front upper edge. A corresponding surface, or plane, at a different angle is formed on the rear face of the rib depending from the front of the lower edge to create an air space for ventilating the joint.

In one form of the invention the rear face of the unit is flatwise against the studs while a front face is inclined to present a clapboard appearance. In another form of the unit both front and rear face are parallel but the tongue and tongue recess position the boards with the upper edge touching the studs and the lower edge spaced away from the studs to permit air circulation. In still another form of the invention, the front and rear surfaces taper away from each other from top to bottom with plural tongues and tongue recesses which position the units with lower edges flatwise against the studs and the upper edges spaced away from the studs for air circulation. In this form the boards are reversible.

DESCRIPTION OF THE PREFERRED EMBODIMENT

Figures 1, 2, 3, 4, 5:
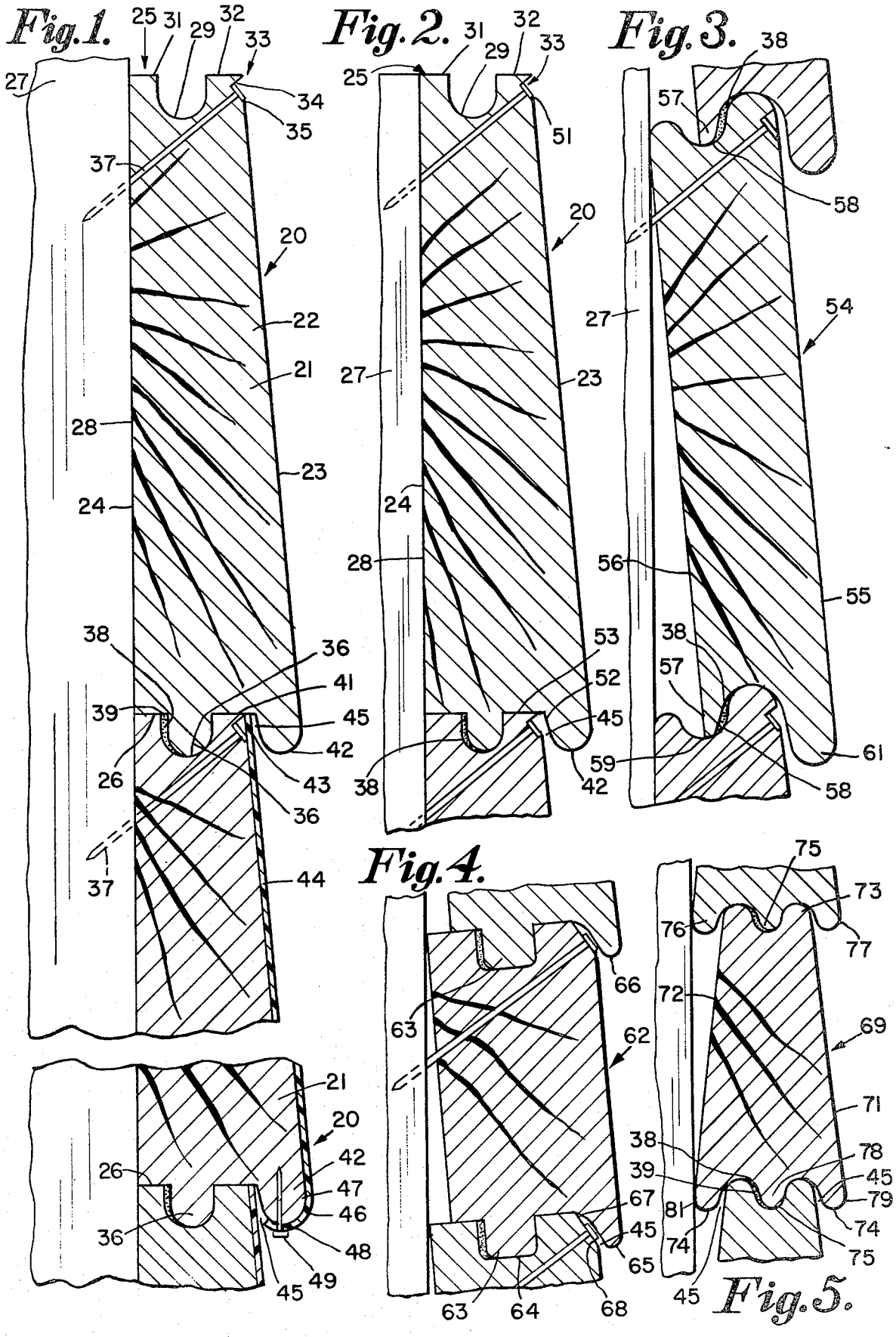
FIG. 1 is an end elevation, in section, of the combined backer board and siding units of the invention
FIG. 2 is a view similar to FIG. 1 showing the nailing surface of the invention
FIG. 3 is a view similar to FIG. 1 showing a modification in which the front and rear surfaces are parallel
FIG. 4 is a view similar to FIG. 1 showing the tongue and tongue recess so located as to permit the use of boards of rectangular cross section.
FIG. 5 is a view similar to FIG. 1 of a modification in which there are plural tongues and tongue recesses and the front and rear surfaces are both tapered

The one piece combined backer and siding board 20 of the invention includes the elongated body 21 of solid, heat insulative material such as wood 22 having a front face 23, a rear face 24, an upper edge 25 and a lower edge 26. In the embodiment of FIGS. 1 and 2, the rear face 24 is normal to the plane of the upper edge 25 and, when applied to stud 27, lies flatwise against the front face 28 of the stud in the conventional manner. The front face 23 of the board 20 is inclined from the vertical to taper outwardly and downwardly from upper edge 25 to lower edge 26.

Unlike relatively thin shingles, clapboards and novelty siding which must be nailed to backer boards, or plywood panels which in turn are nailed to studs, the boards 20 of this invention are about one and one quarter inches thick at the upper edge 25 and about one and one half inches thick at the lower edge 26 to provide sufficient rigidity and insulation between the conventionally sixteen inch spaced studs 27 to require no reinforcement.

The relatively thick upper edge 25 includes a sealing groove 29 of curved cross section and predetermined dimensions which extends longitudinally along the central portion thereof and which is flanked on each opposite side by the rear, integral upstanding rib 31 and the front, integral upstanding rib 32. As shown in FIG. 1 the front rib 32 preferably includes an under cut longitudinally extending groove 33, which serves as a water check and toe nail groove. The angular cross section of groove 33 permits the upper angular surface 34 to block admission of water into the joint between boards while the lower angular surface 35, preferably at 45° to the vertical, provides a nailing surface which guides nails, driven normal thereto, below sealing groove 29, without entering the groove, and into a stud 27.

The relatively thick lower edge 26 of body 21 includes a downwardly depending, integral sealing tongue 36 of predetermined dimensions and curved cross section which extends longitudinally along the intermediate portion of the lower edge. The dimensions of each tongue 36 and tongue groove 29 are such that when a lower board 20 is nailed by a nail 37 to a stud 27 and the tongue of a next higher board 20 is inserted in the tongue groove there is sufficient clearance, or space, 38 at the rear of the groove 29 to receive a substantial amount of caulking compound 39, thereby filling the groove 29 and tightening the seal of the joint 41 between boards.

Each board 20 includes an integral, downward depending front rib 42, which extends longitudinally along lower edge 26, parallel to the tongue 36 and which preferably is of curved cross section as shown. If the rib 42 is considered to form a rabbett groove at the lower edge 26, then the sealing tongue 36 is central of the rabbett groove as shown. It will be seen that if, as proposed in the prior art, an upper tongue is seated in a lower tongue groove, and a lower outer rib is also provided, there is substantial waste of lumber whereas in this invention by tongue grooving the upper edge and forming the depending integral, sealing tongue alongside the depending integral front rib there is much less waste of material.

As shown in FIG. 1, in the lowermost board 20, nailed to stud 27, the upper edge 43 of a vinyl plastic covering 44 may be inserted in the space 45 behind the rib 42 and the lower portion 46 thereof may be precurved to fit around the curved surface 47 of rib 42 for nailing through holes 48 by nails 49.

In FIG. 2 another embodiment is illustrated in which the front rib 32 of each board 20 includes a beveled surface 51, corresponding to surface 35 and the rib 42 of each board 20 includes a rear face 52, uniformly spaced from the front face 23 to create a substantial air space 45.

In FIG. 3 still another embodiment is illustrated in which the board 54, corresponding to board 20, has the front face 55 parallel to the rear face 56 and the front face 55 is still inclined in the manner of shingles or clapboards by the positioning and structure of the tongue 57 and tongue groove 58. As shown, the tongue 57 extends along the lower edge 59 of the board parallel to the cover rib 61 but the rib 61 is of greater depth than tongue 57. This construction not only enables boards of rectangular cross section to be used but also spaces the lower edges 59 away from the studs 27 to give air access all around the board to prolong the useful life of certain wood.

In the embodiment of FIG. 4 a board 62 of rectangular cross section is also used, the tongue 63 in the lower edge 64 being equal in depth to the depth of the rib 65 and the rib 65 and front upper rib 66 having beveled nailing surfaces 67 and 68 respectively which form an air space 45.

In the embodiment of FIG. 5 the board 69 has a front face 71 and a rear face 72 which are both inclined and taper away from each other from upper edge 73 to lower edge 74. The cross section of board 69 is thus symetrical so that the board is reversible. A central tongue groove 75 is flanked by rear rib 76 and front rib 77 all of curved cross section in the upper edge 73. A central tongue 78 in the lower edge 74, seats in the tongue groove 75 of the next lowermost board, and is flanked by a lower rib 79 and a lower rear rib 81. A caulking space 38 for caulking compound 39 is provided in groove 75 and an air space 45 is provided under cover rib 77.

Figure 6:
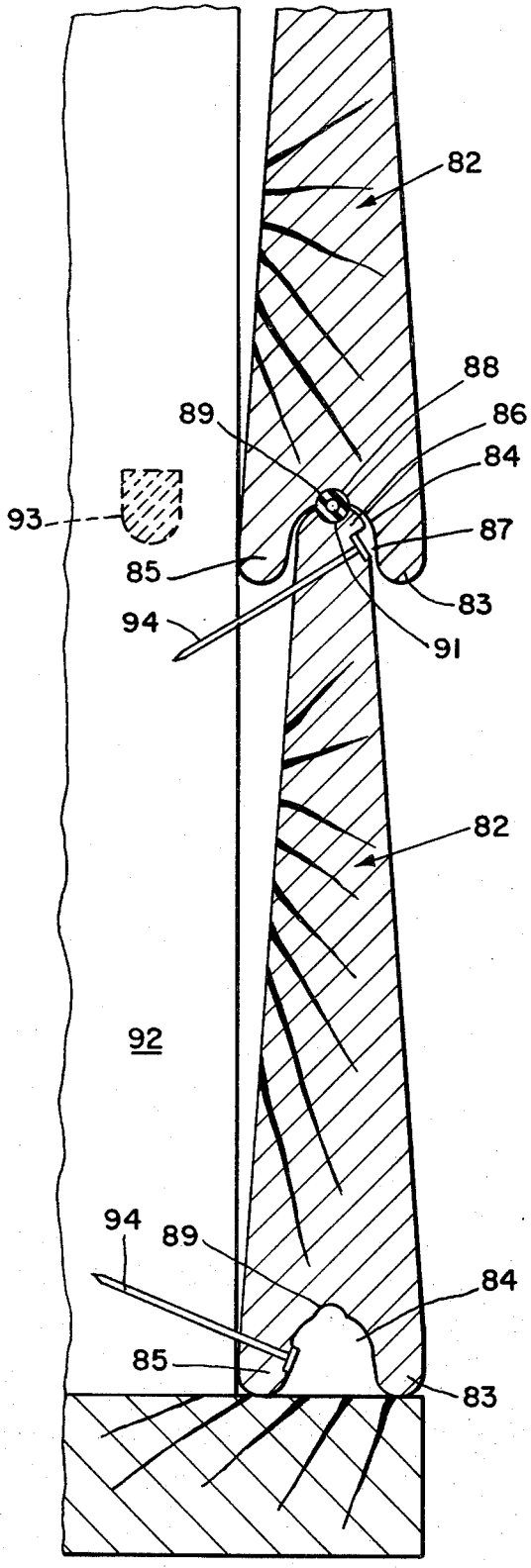
FIG. 6 is a view similar to FIG. 5 of a reversible board, the sealing tongue being formed by an elongated flexible, resilient member

As shown in FIG. 6 a reversible board 82, corresponding to reversible board 69 of FIG. 5, is provided with a front, lower, cover rib 83, a central, lower groove 84, a rear, lower rib 85 and an upper edge tongue 86 which fits in the tongue groove 84 of the next higher board. An air space 87, corresponding to air space 45 is provided under cover rib 83 to ventilate the joint. In this embodiment, instead of an integral, depending, sealing tongue in the lower edge of each board, a resilient, compressible, element 88, which may be of O ring material and configuration, such as of rubber, is seated in a groove 89, to depend downwardly for also seating in a corresponding tongue groove 91 in the upper edge, or tongue 86, of the next lower board. The reversible boards 82 are affixed from bottom to top of vertical studs 92, by means of the shims 93 shown in dotted lines, for positioning the bottom board at the correct angle by screws or nails 94. The shims 93 are then removed and successive, upper boards are self-positioned, without shims, an elongated member 88 being placed in the grooves 89 and 91 for slight compression, to seal each joint.

Figure 7:
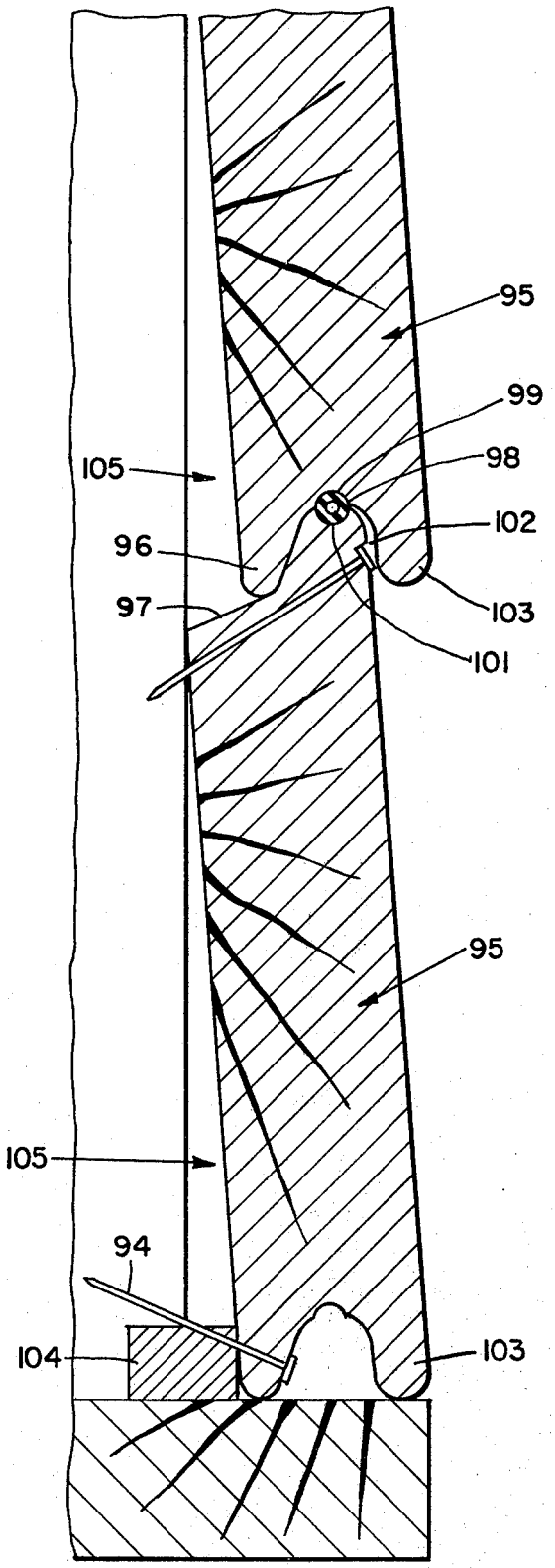
FIG. 7 is a view similar to FIG. 3 of the preferred form of the invention in which standard width boards are provided with the tongue, groove, rib and air spaces of the invention.

In the preferred embodiment of FIG. 7, the combined backer board and siding 95 is formed from standard boarding of uniform thickness so that no special knives are required to taper one or both faces thereof. Each board 95 corresponds to board 54 of FIG. 3 except that the rear lower tongue 96, corresponding to rear lower tongue 57, is seated on a downward sloping surface 97 to permit run-off of any accumulation of moisture in the joint. Instead of a caulking space, caulking compound and integral depending sealing tongue in a tongue groove, the board 95 includes a sealing gasket 98, similar to element 88 of FIG. 6, the sealing gasket 98 being of resilient, flexible, compressible rubber or the like seated in a suitable gasket groove 99 in the tongue groove 84 in the board 95, and in a corresponding gasket groove 101 in the upper tongue 86 in the next lower board and being compressed for a firm, tight seal when one board 95 is affixed above another as illustrated in FIG. 7. An air space 102, similar to air space 45, is provided under cover tongue, or rib, 103 to ventilate the joint. The shim 104 forms the starter for the boards 95, nailed by nails or screws 94. The air space 105 is advantageous from an insulation point of view in the finished wall of a building.

I claim:

1. A unitary combined backer board and clapboard comprising:

a standard wood board of uniform thickness having parallel front and rear faces, an upper edge and a lower edge;

said board being sufficiently thick and strong to be affixed with other identical said boards, horizontally one upon another, each at a slight incline from the vertical, directly onto vertical studs of a building;

said upper edge having an integral, elongated, upstanding tongue, of predetermined curvature, extending along the front edge portion thereof to shed rainwater, and having an elongated, downward-sloping surface, extending along the rear edge portion thereof from said upstanding tongue to said rear face to shed rainwater;

and said lower edge having an elongated tongue groove of predetermined curvature, for receiving the upstanding tongue of the next lower board, said groove extending longitudinally along the intermediate portion of said lower edge;

said lower edge having an integral, depending, rear, lower tongue extending longitudinally along the rear portion thereof and adapted to seat on the downward sloping surface of the next lower board and said lower edge having an integral, depending, front, lower, cover tongue extending longitudinally along the front portion thereof for covering the joint with the said next lower board;

the upstanding tongue of each said lower board fitting in the tongue groove of the next higher board with a predetermined clearance to form a front, air space for ventilating said joint;

and said board being free of any upstanding rear upper tongue, and free of any groove in the upper edge thereof, capable of retaining water.

2. A unitary combined backer board and clapboard, as specified in claim 1 wherein:

said board includes a gasket groove extending along the upper central portion of said tongue groove;

and an elongated sealing gasket of resilient, flexible compressible rubber, or the like, seated in said gasket groove;

said sealing gasket being adapted to be compressed for a firm, tight seal when said board is affixed horizontally above another said board.

3. A unitary combined backer board and clapboard, as specified in claim 1 wherein:

said rear lower tongue and said front lower tongue are each substantially equal in length and cross sectional curvature.

4. A unitary combined backer board and clapboard, as specified in claim 1 wherein:

said rear lower tongue is of less thickness than the thickness of said front lower tongue.

5. A unitary combined backer and siding board of the type sufficiently thick and strong to be affixed horizontally directly onto vertical studs of a building without an underlying layer of backer boards, plywood or the like:

said board having a lower edge, an upper edge, a rear face, a front face, and a longitudinal groove in said lower edge adapted to receive a longitudinal tongue upstanding along the front of the upper edge of the next lower board;

said board characterized by said front face and rear face being in parallelism;

said upper edge being free of grooving and having a downward sloping, longitudinal surface extending from said upstanding tongue to said rear face to shed water;

whereby said board has no pockets, or grooves in the upper edge, in which rainwater may accumulate.

6. A unitary combined backer and siding board as specified in claim 5: plus resilient, flexible, compressible gasket means of rubber, or the like, extending longitudinally in said tongue groove and adapted to be compressed by the upstanding tongue of the next lower board to create a firm seal when one said board is affixed horizontally above another on said studs.

7. A plurality of unitary, combined backer boards and clapboards:

each said board having a lower edge, an upper edge, a rear face, a front face parallel to said rear face, a longitudinally extending tongue upstanding from the front of said upper edge and a longitudinally extending tongue groove in the central portion of said lower edge, said board characterized by;

each said tongue and groove being of curved cross section and configured to have an air space along the front of the joint between boards;

a downward sloping rear surface on said upper edge extending longitudinally between said upstanding tongue and said rear face; and sealing means of flexible, resilient, compressible material extending longitudinally along said front upstanding tongue for preventing water from entering said joint and accumulating in the upper edge of said board.

* * * * *